United States Patent [19]

De Bliquy et al.

[11] 4,325,648

[45] Apr. 20, 1982

[54] TUBE CLAMP

[75] Inventors: Michael C. De Bliquy, Orange Grove; Branko Nikolić, Norwood, both of South Africa

[73] Assignee: Design Research Marketing (Proprietary) Limited, Johannesburg, South Africa

[21] Appl. No.: 131,243

[22] Filed: Mar. 17, 1980

[51] Int. Cl.[3] ..... F16B 1/00

[52] U.S. Cl. ..... 403/218

[58] Field of Search ..... 403/218, 174, 178, 171, 403/176, 217, 175, 173, 170, 172; 52/80

[56] References Cited

U.S. PATENT DOCUMENTS

| | | | |
|---|---|---|---|
| 3,507,526 | 4/1970 | Packman et al. | 403/173 |
| 4,070,847 | 1/1978 | Madl, Jr. | 403/171 |
| 4,099,888 | 7/1978 | Simone | 403/172 |

FOREIGN PATENT DOCUMENTS

| | | | |
|---|---|---|---|
| 936029 | 2/1948 | France | 403/175 |
| 1405586 | 9/1975 | United Kingdom | 403/173 |
| 618511 | 8/1978 | U.S.S.R. | 403/171 |

*Primary Examiner*—Andrew V. Kundrat

*Attorney, Agent, or Firm*—McAulay, Fields, Fisher, Goldstein & Nissen

[57] ABSTRACT

A space frame has nodes which are made up of juxtaposed plates with the ends of the frame chords sandwiched between them. The chord ends are equipped with collars that have projecting diametrically opposed nibs that fit into corresponding apertures in the plates. The collars may be cruciform in shape, with shoulders between the nibs against which the plates bear to prevent direct clamping of the chords. A second pair of plates to receive the ends of diagonal chords may be bolted to the first pair by a single bolt passed through registering central holes in the plates.

5 Claims, 2 Drawing Figures

TUBE CLAMP

FIELD OF THE INVENTION

This invention relates to those assemblies of elongated structural elements which make up what is known as space frames. Such frames comprise a series of connectors, or nodes, to which convergent frame elements such as chords, and more often than not diagonals, are secured and which constitute the means to hold the assembly together.

BACKGROUND OF THE INVENTION

Requirements for efficient nodes are strength, ease of assembly, versatility and reasonable cost. The object of the present invention is to provide nodes which meet these desiderata.

SUMMARY OF THE INVENTION

According to the invention, a space frame includes a node made up of an assembly of elements consisting of two juxtaposed plates, with the ends of the frame elements sandwiched between them, each frame element terminating in a formation providing two diametrically opposed nibs projecting normally to the axis of the element; the plates including apertures for the nibs; and means to clamp the plates together.

Further according to the invention, the formations provide cross shoulders to be engaged by the plates when the assembly is clamped together. Further according to the invention, a further pair of clamping plates is provided to accommodate a second set of elements at an angle to the first set.

THE DRAWINGS

Two embodiments of the invention are shown in the accompanying drawings, in which:

FIG. 1 is a perspective view of a node of a space frame, with a single set of radiating chord elements in a common plane, and FIG. 2 is a perspective view of a space frame node with a set of chords, and a set of diagonals.

DETAILED DESCRIPTION OF THE DRAWINGS

Figure 1:
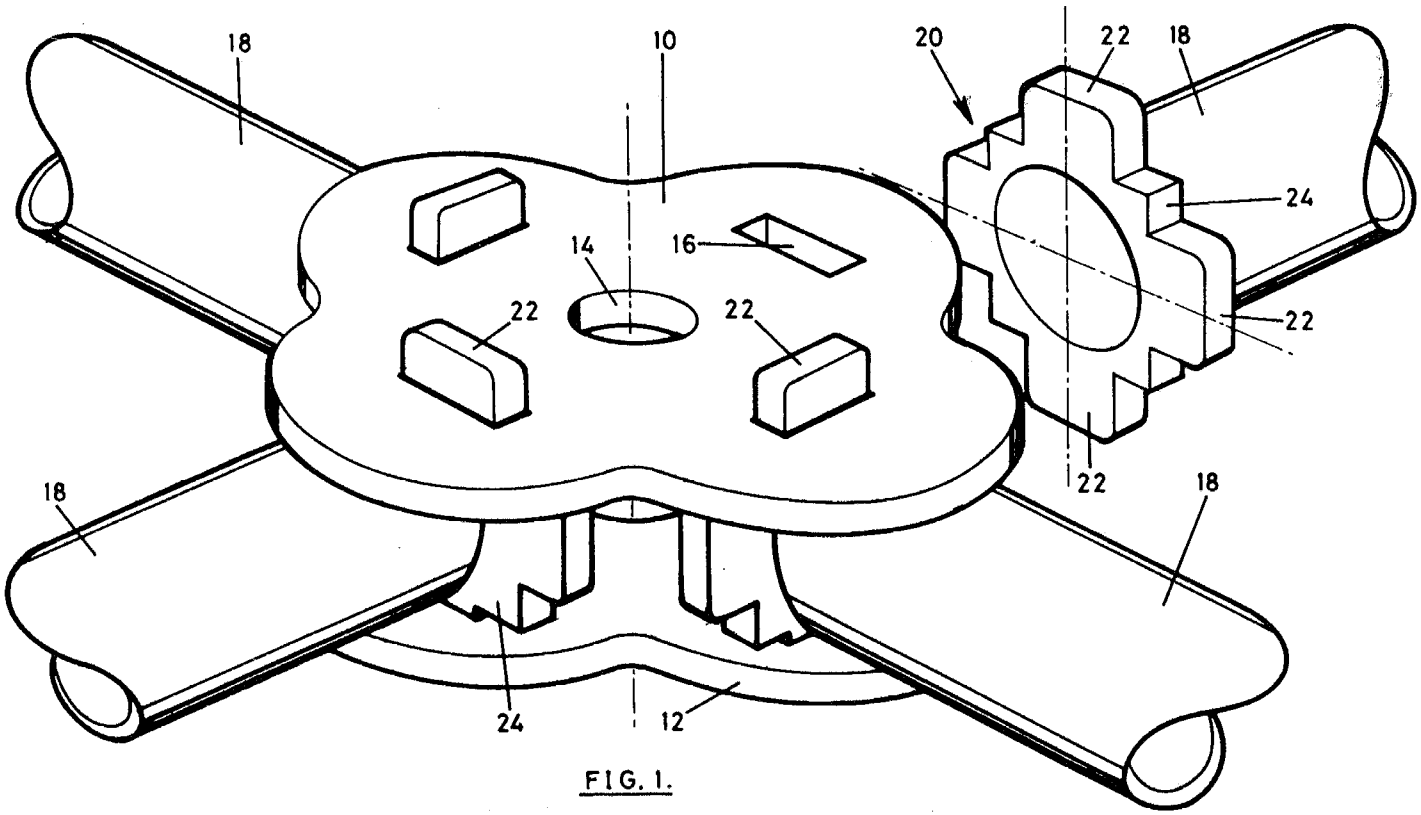

In FIG. 1, the node is shown as consisting of two identical flat plates 10, 12 each of which has a central hole 14 and four slots 16 symmetrically arranged around it.

Each of the chords 18 of a space frame terminates in a collar 20 which is of cruciform shape. The nibs 22 of the collar are dimensioned to fit into any of the slots 16. Between adjacent nibs there is a step 24, providing two shoulders at right angles to each other.

In use, a nib 22 on each chord member is engaged with a slot 16 in one of the plates 10 or 12 and, when all the chords have been thus engaged, the second plate is brought into position with opposed nibs 22 on each chord member in its slots, and the assembly is bolted together through the central holes 14. The clamping of the chord members occurs at the shoulders of the steps 24, so that no pressure is applied to the member itself.

The chord members 18 can, therefore, be thin-walled tubes, to cut down on cost and weight of the frame.

Figure 2:
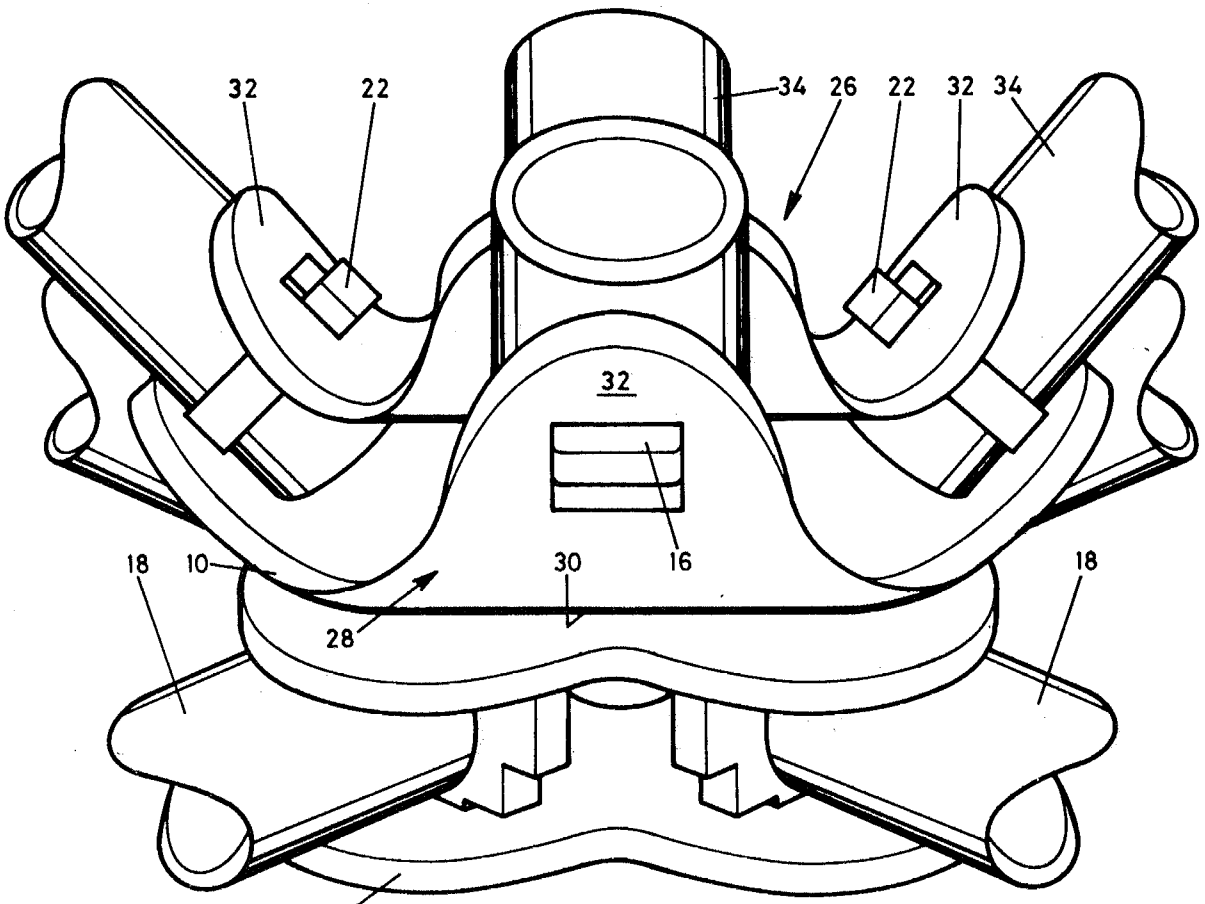

The embodiment of FIG. 2 has the same structure as the embodiment of FIG. 1, but there is added to it a second pair of clamping plates 26,28. One of the plates 28 has a flat base 30 which rests on the top plate 10 of the chord structure and which is apertured for the projecting nibs 22 of the lower set of chord members 18 to pass through them. Radiating from the base 30 are four upwardly angled leaves 32 each of which is slotted to receive nibs 22 on the collars 20 of the diagonal frame members 34. The upper plate 28 is similarly shaped and slotted to receive the opposed nibs 22. The slots 16 in the upper plate 28 are, however, larger in the axial direction of the members 34 to facilitate engagement of the plate over the nibs 22 of the frame members 34.

The assembly is held together by a single bolt passed through the registered central holes 14, and a nut on it.

In both embodiments the collars 20 are symmetrical, so that they can be engaged with the plates in any of four orientations, which facilitates assembly.

When assembled, the frame elements 18 and 34 are stably held within the nodes and are restrained against movement relatively to them. Furthermore, the plates and collars are pressings, so that the constructon is economical.

The invention is not limited to the precise constructional details as herein described. It is, for example, not necessary that the base 30 of the clamping plate 28 be holed to accommodate the nibs 22 of the lower clamp and the upper clamp for the diagonals may merely rest on the ends of the nibs which project from the plate 10. Additionally, the clamping plates of the nodes could be suitably modified to clamp any practical number of frame elements and not only four as illustrated in the drawings.

We claim:

1. In a space frame, the combination of:

a node consisting of two juxtaposed clamping plates, with the ends of said frame members sandwiched between them, each said frame member terminating in a formation providing two diametrically opposed nibs projecting normally to the axis of the member, the plates including apertures for the nibs;

the end of each said frame member terminating in a collar having opposed nibs which pass through opposed apertures in the plates, and shoulders against which the plates bear; and means to clamp the plates together.

2. The combination of claim 1 in which each collar is symmetrical, with four nibs and with a step between adjacent nibs to provide the shoulders.

3. The combination of claim 1 in which the plates are flat.

4. The combination of claim 3, including a further pair of clamping plates to receive the ends of a plurality of diagonal frame members, each of the further plates having aperture for passage through them of the nibs of the diagonal frame members, one of the plates including a flat to rest on the upper plate of the first pair of plates.

5. The combination of claim 4 in which the two pairs of plates are secured together by a common fastening means passed through registering central apertures in the plates.

* * * * *